US006513409B1

(12) United States Patent
Lee

(10) Patent No.: US 6,513,409 B1
(45) Date of Patent: Feb. 4, 2003

(54) RATCHET WRENCH STRUCTURE

(76) Inventor: Daniel Lee, No. 62, Jen-Mei Rd., 3 Lin, Jen Hua Li, Tali City, Taichung Hsien (TW)

( * ) Notice: Subject to any disclaimer, the term of this patent is extended or adjusted under 35 U.S.C. 154(b) by 0 days.

(21) Appl. No.: 10/055,191

(22) Filed: Jan. 25, 2002

(51) Int. Cl.[7] ..... B25B 13/46
(52) U.S. Cl. ..... 81/63; 81/63.2
(58) Field of Search ..... 81/60–63.2

(56) References Cited

U.S. PATENT DOCUMENTS 5,957,009 A * 9/1999 McCann ..... 81/63.2
6,164,167 A * 12/2000 Chen ..... 81/63.2

* cited by examiner

*Primary Examiner*—D. S. Meislin
(74) *Attorney, Agent, or Firm*—Charles E. Baxley

(57) ABSTRACT

The present invention relates to a ratchet wrench structure including a wrench body, a ratchet wheel, a pawl member, and a control knob. The wrench body has a drive head formed with an operation space for receiving the ratchet wheel, a control space for receiving the control knob, a connecting space between the operation space and the control space for receiving the pawl member. The pawl member is provided with a control spring that is provided with a control ring. The control knob has a control rod is passed through the control ring of the control spring, for moving and displacing the control ring of the control spring.

5 Claims, 8 Drawing Sheets

RATCHET WRENCH STRUCTURE

BACKGROUND OF THE INVENTION

1. Field of the Invention

The present invention relates to a ratchet wrench structure, and more particularly to a ratchet wrench structure which has a simple construction and may be processed easily.

2. Description of the Related Art

A conventional ratchet wrench structure in accordance with the prior art shown in FIGS. 7 and 8 comprises a wrench body 50, a ratchet wheel 60, a pawl member 70, and a control knob 80.

The wrench body 50 has a distal end formed with a drive head 52. The drive head 52 of the wrench body 50 has a first side formed with an operation space 520 for receiving the ratchet wheel 60 and the pawl member 70, and a second side formed with a control space 522 for receiving the control knob 80. The operation space 520 of the drive head 52 of the wrench body 50 has a top portion formed with an annular flange 521, and a bottom portion formed with a depression 523. The operation space 520 of the drive head 52 of the wrench body 50 has a wall formed with a recess 529. The drive head 52 of the wrench body 50 is formed with a screw hole 525 and a receiving hole 528 located in the control space 522 of the drive head 52 of the wrench body 50.

The ratchet wheel 60 is mounted in the operation space 520 of the drive head 52 of the wrench body 50, and has an outer wall formed with multiple ratchet teeth 62. A snap ring 64 is secured in the depression 523 of the operation space 520 of the drive head 52 of the wrench body 50, so that the ratchet wheel 60 may be retained in the operation space 520 of the drive head 52 of the wrench body 50 by the annular flange 521 and the snap ring 64.

The pawl member 70 is pivotally mounted in the operation space 520 of the drive head 52 of the wrench body 50, and has a first side formed with multiple engaging teeth 72 detachably meshing with the ratchet teeth 62 of the ratchet wheel 60, and a second side formed with a recess 76 for receiving a first end of a spring 74 whose second end is received in the recess 529 of the operation space 520 of the drive head 52 of the wrench body 50. The pawl member 70 is provided with two rods 78.

The control knob 80 is rotatably mounted in the control space 522 of the drive head 52 of the wrench body 50, and is formed with a control lever 81 for rotating the control knob 80. The control knob 80 is formed with a slot 85 for receiving the two rods 78 of the pawl member 70. A screw 87 is extended through a counterbore 82 formed in the control knob 80, and is screwed into the screw hole 525 of the wrench body 50. The control knob 80 is formed with multiple positioning holes 84. A spring 86 is received in the receiving hole 528 of the wrench body 10, for urging a ball 88 which may be positioned in one of the positioning holes 84 of the control knob 80.

In operation, the control knob 80 may be rotated to turn the two rods 78 of the pawl member 70, thereby pivoting the pawl member 70, so that the engaging teeth 72 of the pawl member 70 may mesh with the ratchet teeth 62 of the ratchet wheel 60, so as to rotate a workpiece.

However, such a conventional ratchet wrench structure has a very complicated construction, so that it cannot be processed easily. For example, the control knob 80 needs to be processed with a slot 85, a counterbore 82, and multiple positioning holes 84, the pawl member 70 needs to processed with a recess 76 and two rods 78, and the wrench body 50 needs to be processed with a recess 529, a screw hole 525 and a receiving hole 528. In addition, the spring 74 is easily detached from the recess 76 of the pawl member 70 and the recess 529 of the wrench body 50, thereby jamming and failing the conventional ratchet wrench structure.

SUMMARY OF THE INVENTION

The present invention has arisen to mitigate and/or obviate the disadvantage of the conventional ratchet wrench structure.

The primary objective of the present invention is to provide a ratchet wrench structure which has a simple construction, and may be processed easily.

Another objective of the present invention is to provide a ratchet wrench structure which may be assembled and dismantled conveniently and easily.

A further objective of the present invention is to provide a ratchet wrench structure, wherein the control spring is secured on the pawl member and retained by the control rod, so that the control spring may be positioned rigidly and stably without detachment.

In accordance with the present invention, there is provided a ratchet wrench structure, comprising: a wrench body, a ratchet wheel, a pawl member, and a control knob, wherein:

the wrench body has a distal end formed with a drive head, the drive head of the wrench body has a first side formed with an operation space for receiving the ratchet wheel, and a second side formed with a control space for receiving the control knob, the drive head of the wrench body is formed with a connecting space connected between the operation space and the control space for receiving the pawl member;

the ratchet wheel is mounted in the operation space of the drive head of the wrench body, and has an outer wall formed with multiple ratchet teeth;

the pawl member is pivotally mounted in the connecting space of the drive head of the wrench body, and has a first side and a second side, the first side of the pawl member is formed with multiple engaging teeth detachably meshing with the ratchet teeth of the ratchet wheel, a control spring has a first end secured to a center of the second side of the pawl member, and a second end provided with a control ring that is extended into the control space of the drive head of the wrench body; and the control knob is rotatably mounted in the control space of the drive head of the wrench body, and has a side integrally formed or provided with a control lever for rotating the control knob, a control rod is eccentrically secured on a bottom of the control knob to rotate with the control knob, and is passed through the control ring of the control spring, for moving and displacing the control ring of the control spring.

Further benefits and advantages of the present invention will become apparent after a careful reading of the detailed description with appropriate reference to the accompanying drawings.

DETAILED DESCRIPTION OF THE INVENTION

Figure 1:
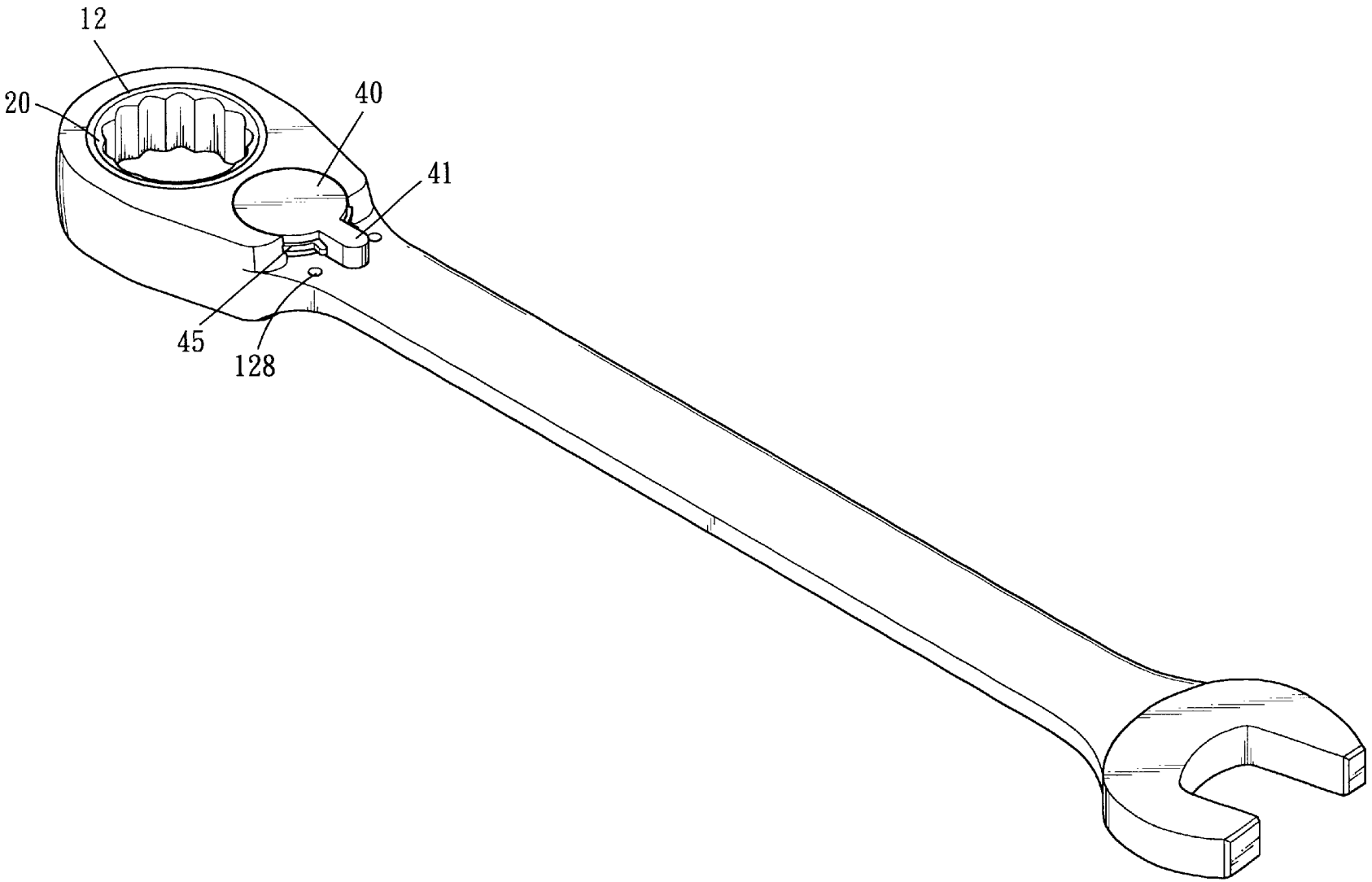
FIG. 1 is a perspective view of a ratchet wrench structure in accordance with a preferred embodiment of the present invention.

Referring to the drawings and initially to FIGS. 1–4, a ratchet wrench structure in accordance with a preferred embodiment of the present invention comprises a wrench body 10, a ratchet wheel 20, a pawl member 30, and a control knob 40.

The wrench body 10 has a distal end formed with a drive head 12. The drive head 12 of the wrench body 10 has a first side formed with an operation space 120 for receiving the ratchet wheel 20, and a second side formed with a control space 122 for receiving the control knob 40. The drive head 12 of the wrench body 10 is also formed with a connecting space 124 connected between the operation space 120 and the control space 122 for receiving the pawl member 30.

The operation space 120 of the drive head 12 of the wrench body 10 has a top portion formed with an annular flange 121, and a bottom portion formed with an annular depression 123. The control space 122 of the drive head 12 of the wrench body 10 has a wall formed with an annular snap groove 126. The wrench body 10 is formed with multiple positioning holes 128 located adjacent to the control space 122 of the drive head 12 of the wrench body 10.

The ratchet wheel 20 is mounted in the operation space 120 of the drive head 12 of the wrench body 10, and has an outer wall formed with multiple ratchet teeth 22. A substantially C-shaped snap ring 24 is secured in the annular depression 123 of the operation space 120 of the drive head 12 of the wrench body 10, so that the ratchet wheel 20 may be retained in the operation space 120 of the drive head 12 of the wrench body 10 by the annular flange 121 and the snap ring 24.

The pawl member 30 is pivotally mounted in the connecting space 124 of the drive head 12 of the wrench body 10, and has a first end 31 and a second end 33, and has a first side and a second side. The first side of the pawl member 30 is formed with multiple engaging teeth 32 detachably meshing with the ratchet teeth 22 of the ratchet wheel 20. A control spring 34 has a first end secured to a center of the second side of the pawl member 30, and a second end provided with a control ring 36 that is extended into the control space 122 of the drive head 12 of the wrench body 10.

The control knob 40 having a circular shape is rotatably mounted in the control space 122 of the drive head 12 of the wrench body 10, and has a side integrally formed or provided with a control lever 41 for rotating the control knob 40. A control rod 42 is eccentrically secured on a bottom of the control knob 40 to rotate with the control knob 40, and is passed through the control ring 36 of the control spring 34, for moving and displacing the control ring 36 of the control spring 34.

The control lever 41 of the control knob 40 has a bottom formed with a receiving recess 44 for receiving an urging spring 46 and a positioning ball 48. The positioning ball 48 may be moved by the control lever 41 of the control knob 40 to be positioned in one of the multiple positioning holes 128 of the wrench body 10, thereby providing a temporary positioning effect to the control lever 41 of the control knob 40.

The control knob 40 has a periphery formed with an annular retaining groove 43. A substantially C-shaped retaining ring 45 is secured between the retaining groove 43 of the control knob 40 and the snap groove 126 of the control space 122 of the drive head 12 of the wrench body 10, for retaining the control knob 40 in the control space 122 of the drive head 12 of the wrench body 10.

Figure 2:
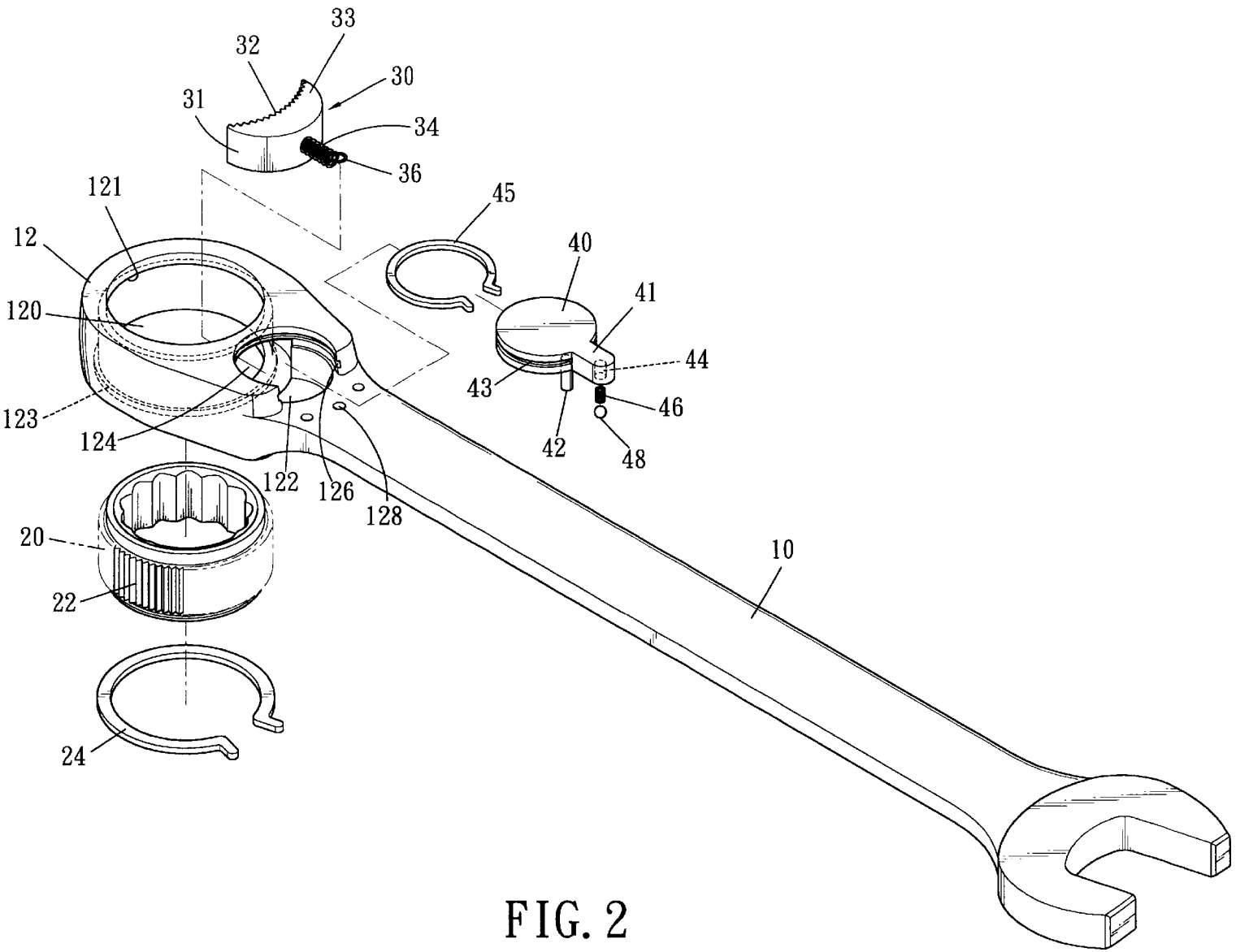
FIG. 2 is an exploded view of the ratchet wrench structure as shown in FIG. 1.
Figure 3:
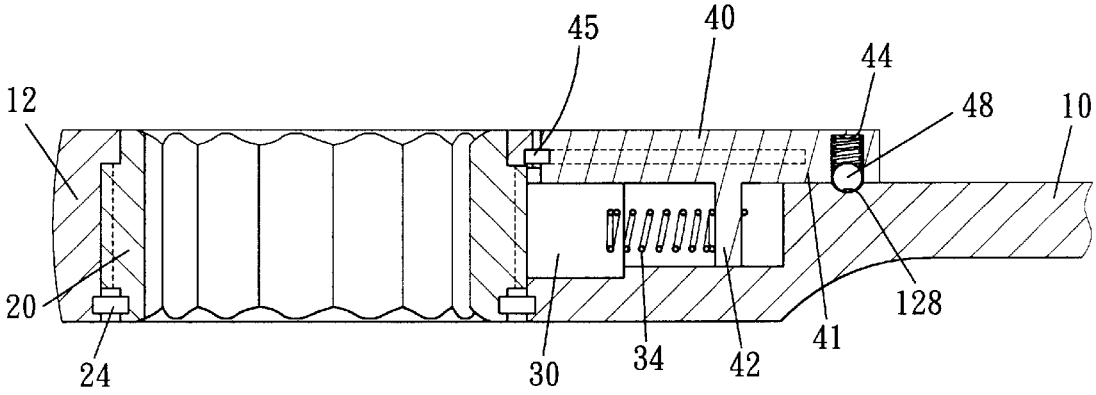
FIG. 3 is a partially cut-away front plan cross-sectional view of the ratchet wrench structure as shown in FIG. 1.
Figure 4:
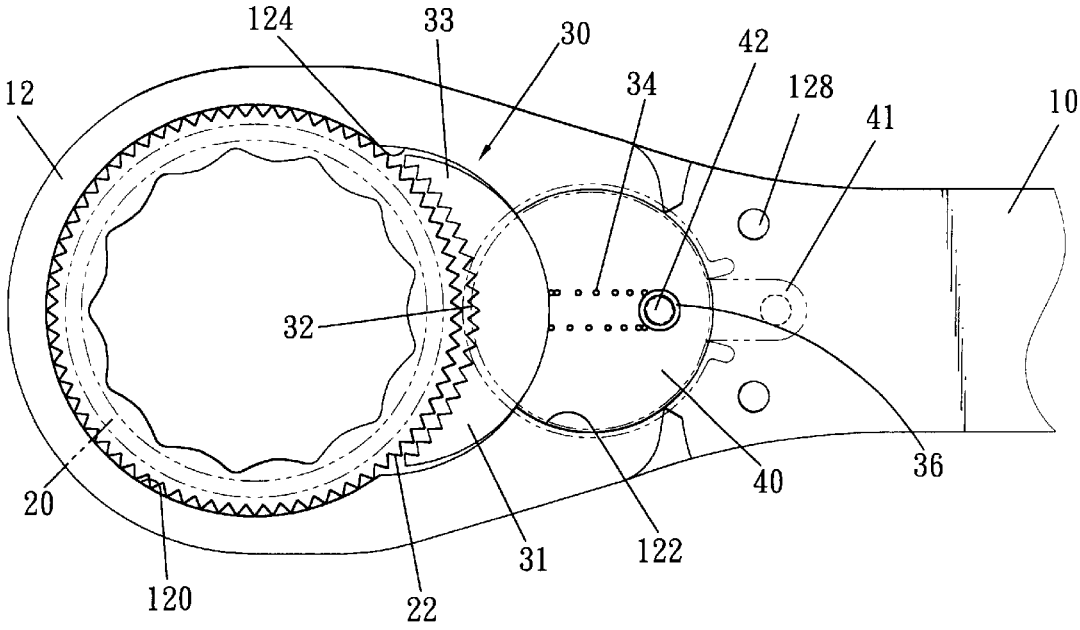
FIG. 4 is a partially cut-away top plan cross-sectional view of the ratchet wrench structure as shown in FIG. 1.
Figure 5:
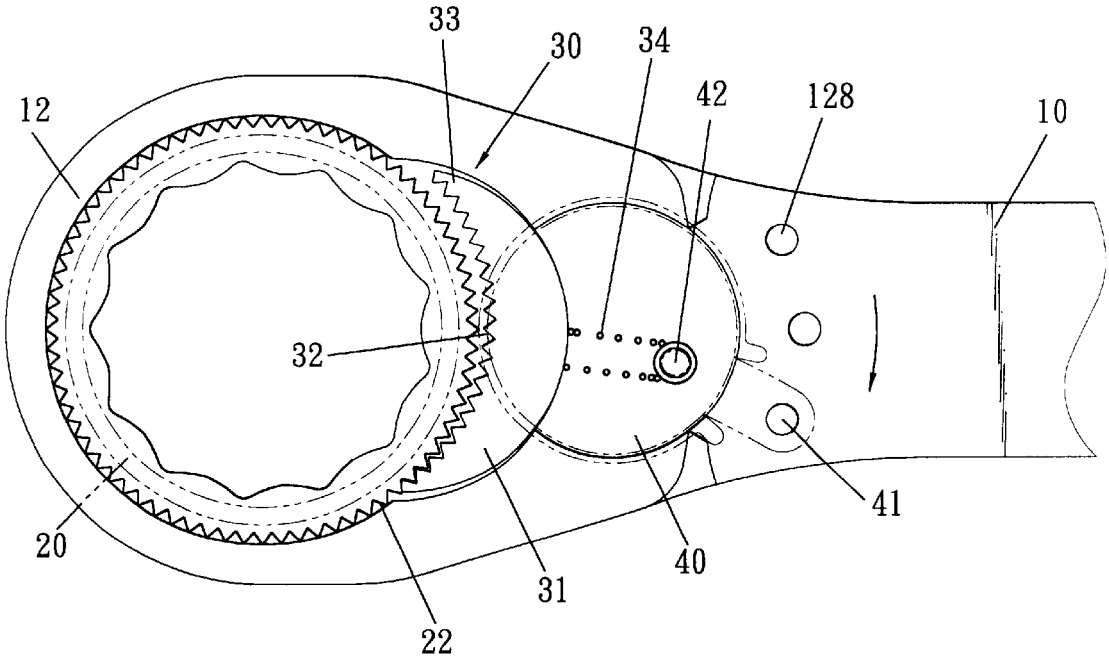
FIG. 5 is a schematic operational view of the ratchet wrench structure as shown in FIG. 4 in use.
Figure 6:
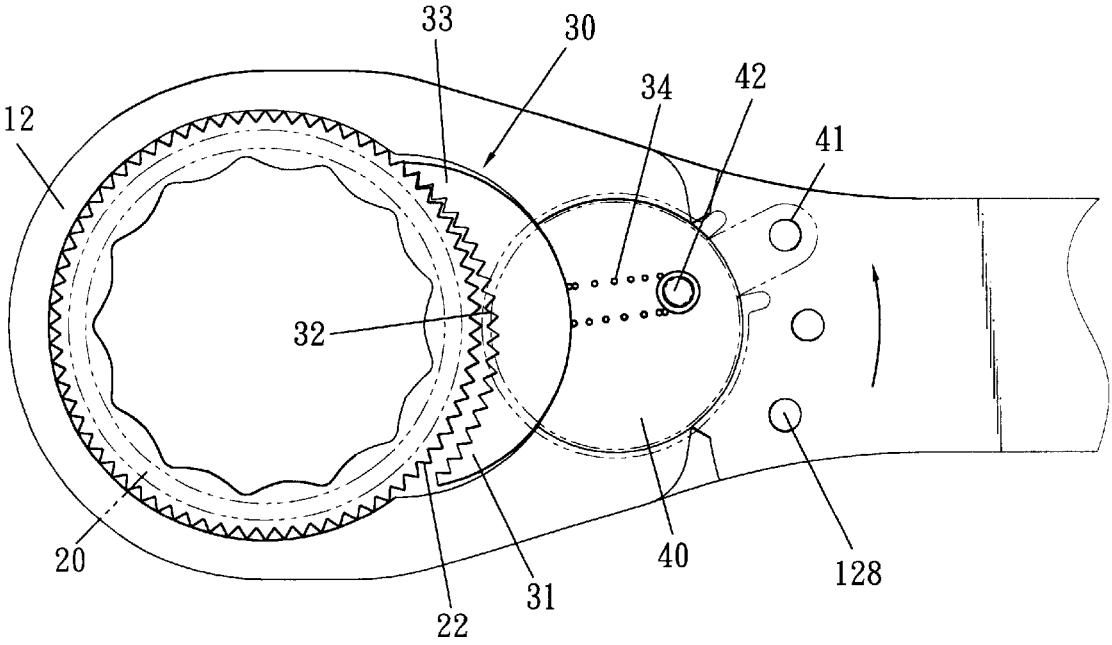
FIG. 6 is a schematic operational view of the ratchet wrench structure as shown in FIG. 4 in use.
Figure 7:
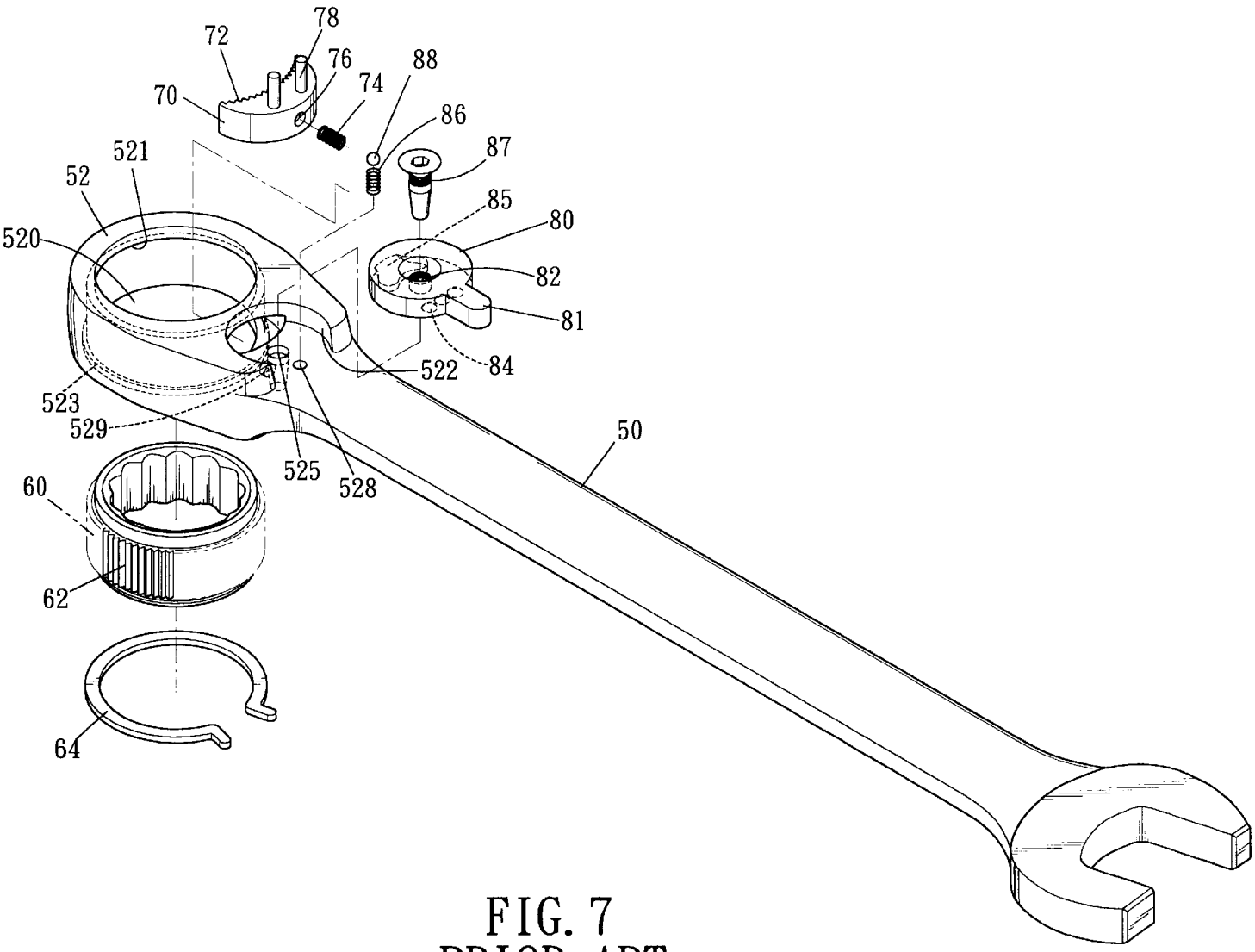
FIG. 7 PRIOR ART
FIG. 7 is an exploded perspective view of a conventional ratchet wrench structure in accordance with the prior art.
Figure 8:
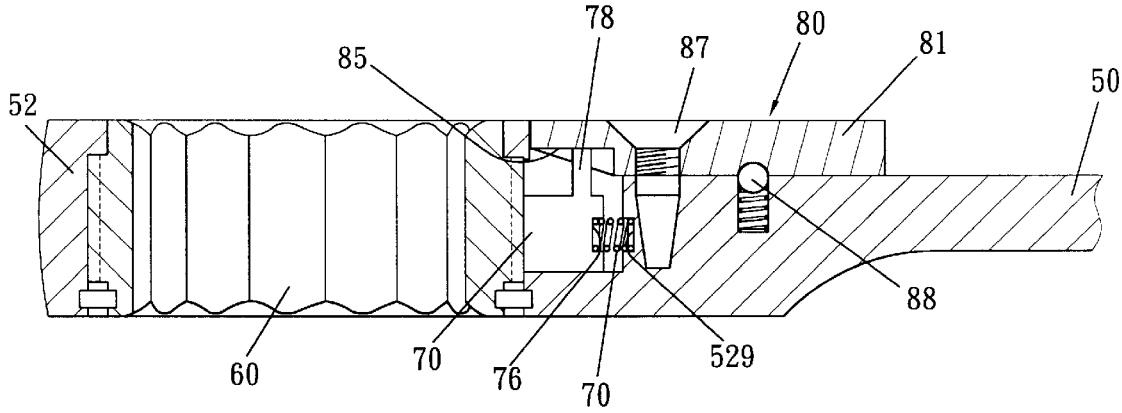
FIG. 8 PRIOR ART
FIG. 8 is a partially cut-away front plan cross-sectional assembly view of the conventional ratchet wrench structure as shown in FIG. 7.

In operation, referring to FIGS. 4–6 with reference to FIGS. 1–3, the control lever 41 and the control rod 42 of the control knob 40 is initially in line with the control spring 34 of the pawl member 30 as shown in FIG. 4, so that the engaging teeth 32 of the pawl member 30 is disengaged from the ratchet teeth 22 of the ratchet wheel 20. Thus, when the drive head 12 of the wrench body 10 is rotated, the ratchet wheel 20 is not rotated with the drive head 12 of the wrench body 10, so that the drive head 12 of the wrench body 10 idles.

The control lever 41 of the control knob 40 may be driven to move from the position as shown in FIG. 4 to the position as shown in FIG. 5 to rotate the control knob 40 which moves the control rod 42 which moves the control ring 36 which turns the control spring 34 which pivots the pawl member 30, so that the engaging teeth 32 at the first end 31 of the pawl member 30 may mesh with the ratchet teeth 22 of the ratchet wheel 20 as shown in FIG. 5.

Thus, when the drive head 12 of the wrench body 10 is rotated clockwise, the ratchet wheel 20 may be rotated with the drive head 12 of the wrench body 10 to rotate a workpiece clockwise. When the drive head 12 of the wrench body 10 is rotated counterclockwise, the ratchet wheel 20 is not rotated with the drive head 12 of the wrench body 10, so that the drive head 12 of the wrench body 10 idles. Thus, the ratchet wheel 20 may be rotated with the drive head 12 of the wrench body 10 to rotate clockwise only.

Alternatively, the control lever 41 of the control knob 40 may be driven to move from the position as shown in FIG. 4 to the position as shown in FIG. 6 to rotate the control knob 40 which moves the control rod 42 which moves the control ring 36 which turns the control spring 34 which pivots the pawl member 30, so that the engaging teeth 32 at the second end 33 of the pawl member 30 may mesh with the ratchet teeth 22 of the ratchet wheel 20 as shown in FIG. 6.

Thus, when the drive head 12 of the wrench body 10 is rotated counterclockwise, the ratchet wheel 20 may be rotated with the drive head 12 of the wrench body 10 to rotate a workpiece counterclockwise. When the drive head 12 of the wrench body 10 is rotated clockwise, the ratchet wheel 20 is not rotated with the drive head 12 of the wrench body 10, so that the drive head 12 of the wrench body 10 idles. Thus, the ratchet wheel 20 may be rotated with the drive head 12 of the wrench body 10 to rotate counterclockwise only.

Accordingly, the ratchet wrench structure of the present invention has a simple construction, and may be processed easily. In addition, the ratchet wrench structure may be assembled and dismantled easily and conveniently. Further, the control spring 34 is secured on the pawl member 30 and retained by the control rod 42, so that the control spring 34 may be positioned rigidly and stably without detachment.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A ratchet wrench structure, comprising: a wrench body, a ratchet wheel, a pawl member, and a control knob, wherein:

the wrench body has a distal end formed with a drive head, the drive head of the wrench body has a first side formed with an operation space for receiving the ratchet wheel, and a second side formed with a control space for receiving the control knob, the drive head of the wrench body is formed with a connecting space connected between the operation space and the control space for receiving the pawl member;

the ratchet wheel is mounted in the operation space of the drive head of the wrench body, and has an outer wall formed with multiple ratchet teeth;

the pawl member is pivotally mounted in the connecting space of the drive head of the wrench body, and has a first side and a second side, the first side of the pawl member is formed with multiple engaging teeth detachably meshing with the ratchet teeth of the ratchet wheel, a control spring has a first end secured to a center of the second side of the pawl member, and a second end provided with a control ring that is extended into the control space of the drive head of the wrench body; and the control knob is rotatably mounted in the control space of the drive head of the wrench body, and has a side integrally formed or provided with a control lever for rotating the control knob, a control rod is eccentrically secured on a bottom of the control knob to rotate with the control knob, and is passed through the control ring of the control spring, for moving and displacing the control ring of the control spring.

2. The ratchet wrench structure in accordance with claim 1, wherein the control space of the drive head of the wrench body has a wall formed with an annular snap groove, the control knob has a periphery formed with an annular retaining groove, and the ratchet wrench structure further comprises a retaining ring is secured between the retaining groove of the control knob and the snap groove of the control space of the drive head of the wrench body, for retaining the control knob in the control space of the drive head of the wrench body.

3. The ratchet wrench structure in accordance with claim 2, wherein the retaining ring is substantially C-shaped.

4. The ratchet wrench structure in accordance with claim 1, wherein the control lever of the control knob has a bottom formed with a receiving recess for receiving an urging spring and a positioning ball.

5. The ratchet wrench structure in accordance with claim 4, wherein the wrench body is formed with multiple positioning holes located adjacent to the control space of the drive head of the wrench body, and the positioning ball may be moved by the control lever of the control knob to be detachably positioned in one of the multiple positioning holes of the wrench body, thereby providing a temporary positioning effect to the control lever of the control knob.

* * * * *